US011815240B1

(12) United States Patent
Shih

(10) Patent No.: US 11,815,240 B1
(45) Date of Patent: Nov. 14, 2023

(54) OPTICAL LENS AND OPTICAL LENS ASSEMBLY HAVING THE SAME

(71) Applicant: T.Y.C. BROTHER INDUSTRIAL CO., LTD., Tainan (TW)

(72) Inventor: Ming-Chih Shih, Tainan (TW)

(73) Assignee: T.Y.C. Brother Industrial Co., Ltd., Tainan (TW)

( * ) Notice: Subject to any disclaimer, the term of this patent is extended or adjusted under 35 U.S.C. 154(b) by 0 days.

(21) Appl. No.: 18/074,273

(22) Filed: Dec. 2, 2022

(51) Int. Cl.
*F21S 41/26* (2018.01)
*F21S 41/36* (2018.01)
*F21W 102/13* (2018.01)

(52) U.S. Cl.
CPC ..... *F21S 41/26* (2018.01); *F21S 41/36* (2018.01); *F21W 2102/13* (2018.01)

(58) Field of Classification Search
CPC ..... F21S 41/26; F21S 41/36; F21W 2102/13; F21V 5/04; F21V 5/043; F21V 5/045
See application file for complete search history.

(56) References Cited

U.S. PATENT DOCUMENTS 9,915,404 B1 * 3/2018 Sun ..... F21S 41/285
10,781,998 B1 9/2020 Shih
2007/0064431 A1 * 3/2007 Fallahi ..... G02B 19/0061 362/334
2010/0135036 A1 * 6/2010 Matsuba ..... F21S 41/322 362/516
2014/0085919 A1 * 3/2014 Tsai ..... F21S 41/143 362/522
2014/0168972 A1 * 6/2014 Ebner ..... B29C 45/0003 362/361
2014/0204591 A1 * 7/2014 Kim ..... F21V 5/04 362/335
2015/0316228 A1 * 11/2015 Saito ..... F21V 17/08 362/311.06
2015/0345748 A1 * 12/2015 Saito ..... G03B 15/05 362/327
2016/0153640 A1 * 6/2016 Iatan ..... F21V 13/04 362/311.06
2016/0223157 A1 * 8/2016 Saito ..... G02B 19/0028
2019/0011110 A1 * 1/2019 Kim ..... F21V 7/0091
2020/0103564 A1 * 4/2020 Lu ..... G02B 19/0028

FOREIGN PATENT DOCUMENTS

TW I697642 7/2020

* cited by examiner

*Primary Examiner* — Zheng Song
(74) *Attorney, Agent, or Firm* — Burris Law, PLLC

(57) ABSTRACT

An optical lens includes a front lens part and a rear lens part disposed rearward of the front lens portion. The rear lens part has a rear end, a light entry portion that is concaved forwardly from the rear end and that is adapted to receive incidence of light rays, and a reflective portion that extends forwardly from the rear end and that surrounds the light entry portion. The reflective portion has two first reflective surfaces respectively disposed on top and bottom sides of the light entry portion, two second reflective surfaces respectively disposed at left and right sides of the light entry portion, and a plurality of third reflective surfaces each disposed between one of the first reflective surfaces and one of the second reflective surfaces. The first, second, and third reflective surfaces together form a discontinuous stepped surface around the light entry portion.

10 Claims, 15 Drawing Sheets

OPTICAL LENS AND OPTICAL LENS ASSEMBLY HAVING THE SAME

FIELD

The disclosure relates to a vehicular lamp, and more particularly to an optical lens and an optical lens assembly having the same for producing a light pattern of a vehicle lamp.

BACKGROUND

As shown in FIGS. 1 and 2, a lens device 1, as disclosed in Taiwanese Patent No. 1697642/U.S. Pat. No. 10,781,998, includes a plurality of optical lenses 11 integrated with one another in a left-right juxtaposition manner. Because the optical lenses 11 are structurally identical to one another, one of the optical lenses 11 will be described hereinafter.

The optical lens 11 is adapted to forwardly projecting light rays for producing a high beam pattern of a vehicle lamp, and includes a first lens part 12 and a second lens part 13 that is connected to and disposed rearwardly of said first lens part 12. The first lens part 12 has a high beam exit surface 121 that is in the form of a portion of a cylindrical surface. The second lens part 13 collects light rays by using the optical characteristics of a hyperbola. The second lens part 13 has a reflecting surface 131 which is formed by one revolution of an arm segment 16 of one of two hyperbolic branches 15 of a hyperbola 14 about an optical axis (A0) of the optical lens 11. The reflecting surface 131 is a continuous surface and is unzoned for having differently designed surface profiles.

SUMMARY

Therefore, one object of the disclosure is to provide an optical lens that can alleviate the drawback of the prior art.

According to the disclosure, an optical lens includes a front lens part and a rear lens part.

The front lens part has a light exit surface adapted to forwardly projecting the light rays.

The rear lens part is disposed rearwardly of the front lens part, and has a rear end, a light entry portion, and a reflective portion. The light entry portion is concaved forwardly from the rear end and is adapted to receive incidence of the light rays. The reflective portion extends forwardly from the rear end and surrounds the light entry portion. The reflective portion has two first reflective surfaces respectively disposed on top and bottom sides of the light entry portion, two second reflective surfaces respectively disposed at left and right sides of the light entry portion, and a plurality of third reflective surfaces each disposed between one of the first reflective surfaces and one of the second reflective surfaces. The first, second, and third reflective surfaces together form a discontinuous surface around the light entry portion.

Another object of the disclosure is to provide an optical lens assembly.

According to the disclosure, the optical lens assembly includes an aforementioned optical lens and a high beam lens.

The aforementioned optical lens is adapted to producing a low beam pattern. The light exit surface of the optical lens is in the form of a portion of a cylindrical surface.

The high beam lens is adapted to forwardly projecting light rays for producing a high beam pattern, and includes a first lens part and a second lens part that is connected to and disposed rearwardly of the first lens part. The first lens part has a front end formed with a high beam exit surface. The high beam exit surface is in the form of a portion of a cylindrical surface and is coplanar with the light exit surface of the optical lens. The second lens part has a light entry surface that is concaved forwardly from a rear end of the second lens part, and a reflecting surface that extends forwardly from the rear end of the second lens part and that surrounds the light entry surface of the second lens part.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
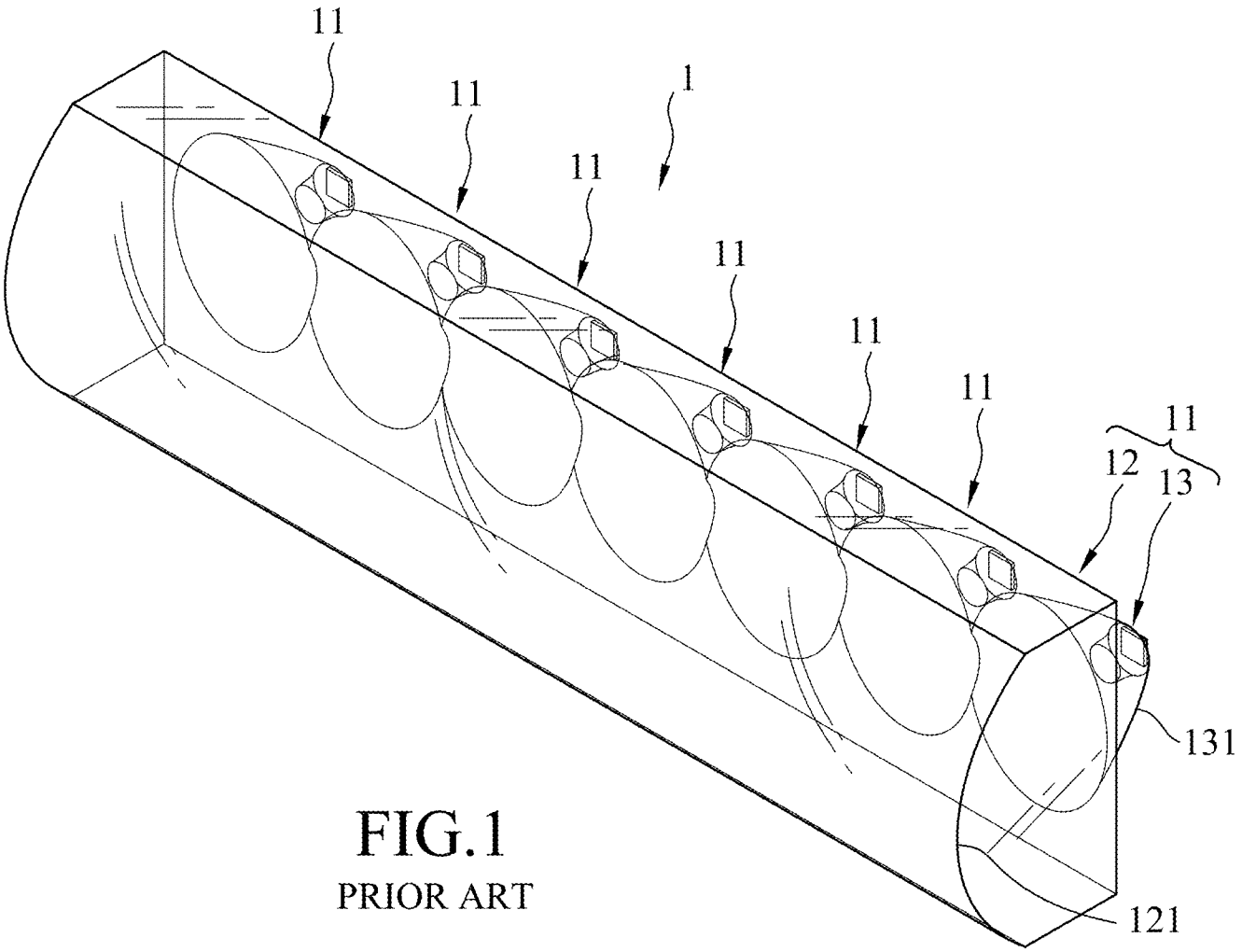
FIG.1 PRIOR ART
FIG. 1 is a perspective view illustrating an existing lens device.
Figure 2:
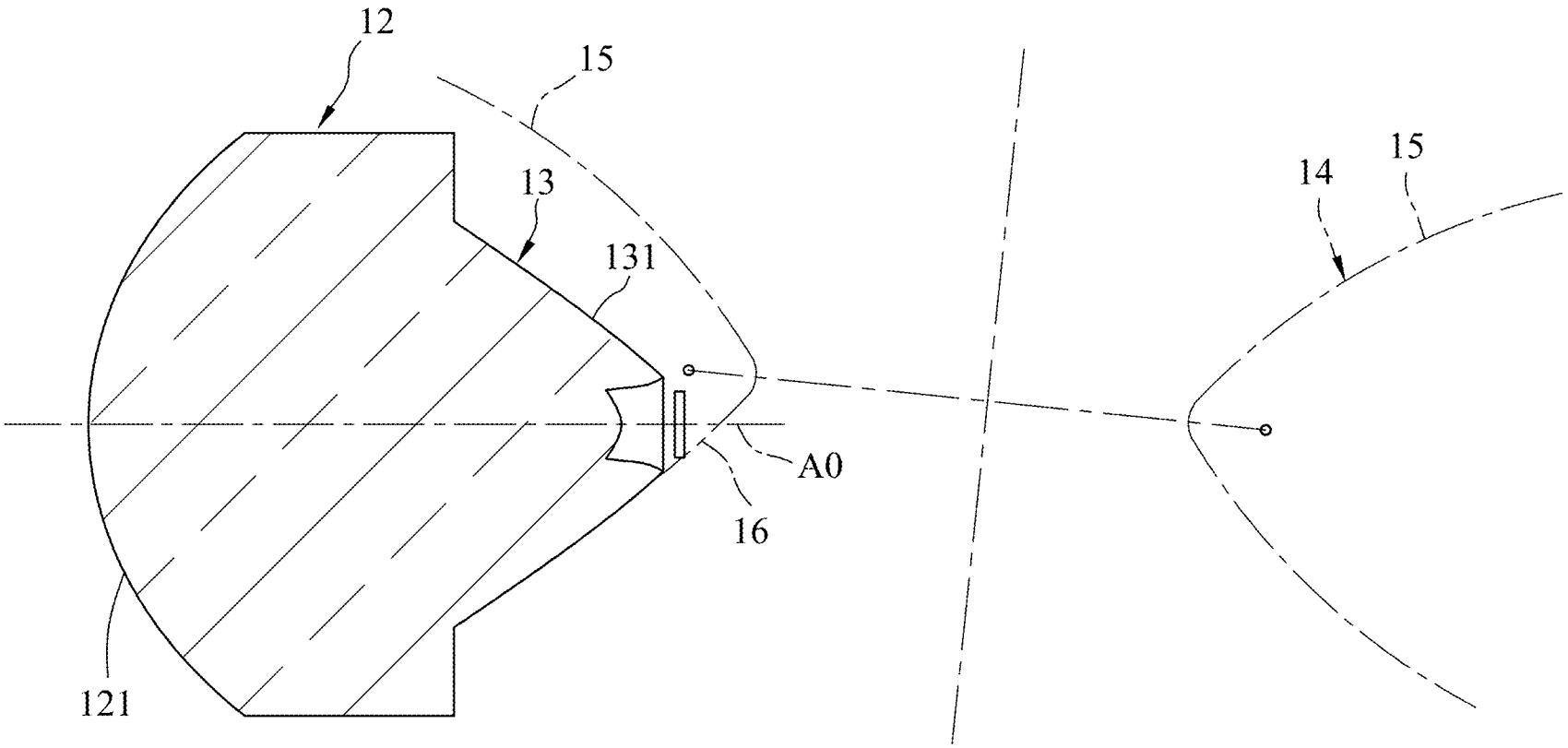
FIG.2 PRIOR ART
FIG. 2 is a sectional view of an optical lens of the existing lens device.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly"

and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 3:
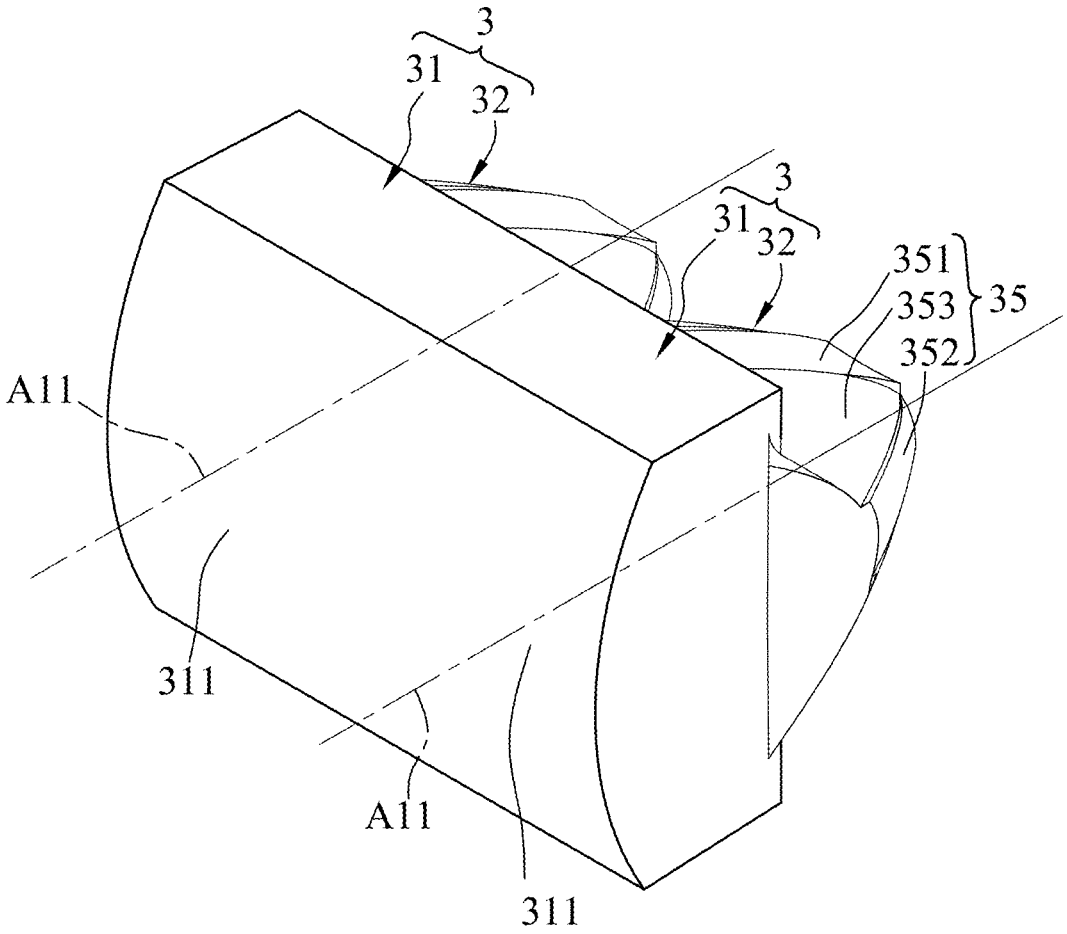
FIG. 3 is a front perspective view illustrating an optical lens assembly according to a first embodiment of the disclosure.
Figure 4:
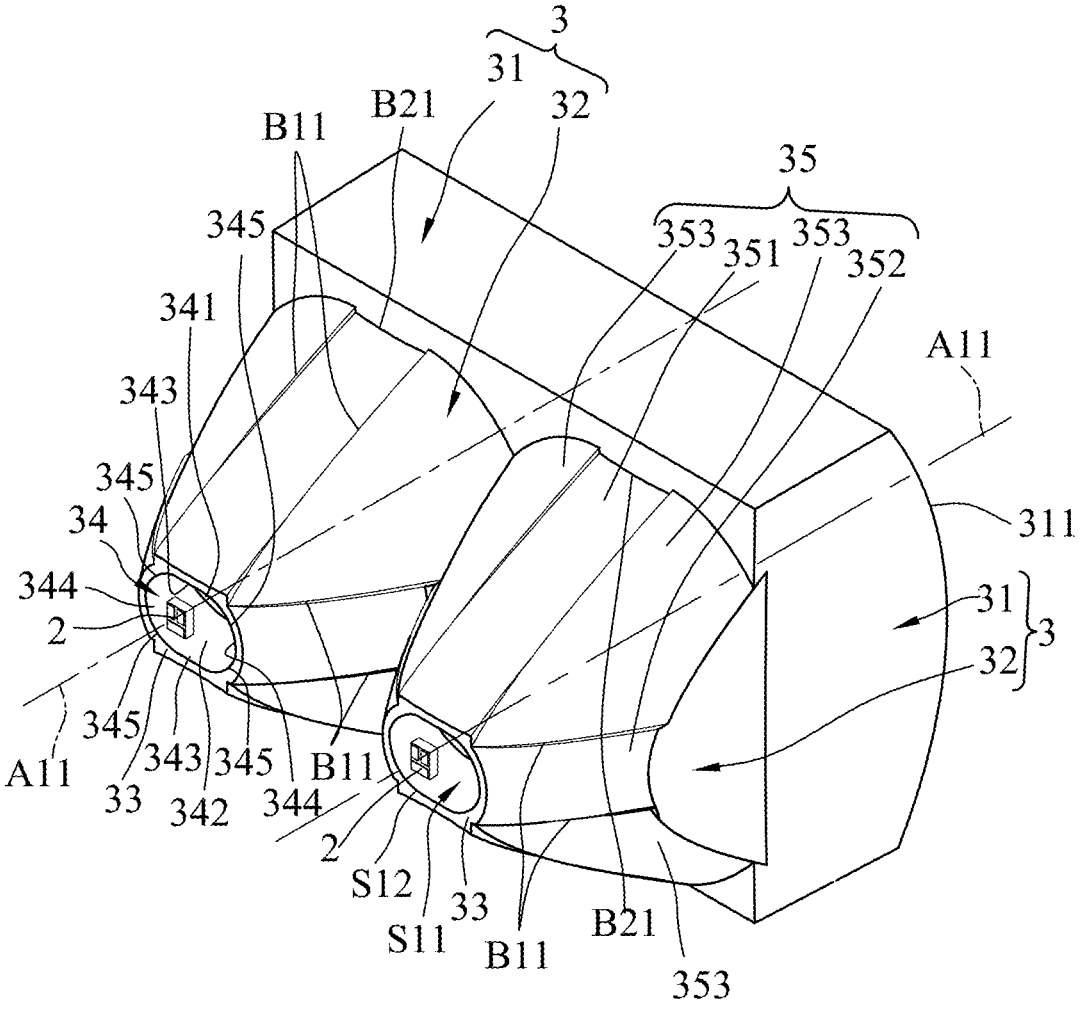
FIG. 4 is a rear perspective view of the first embodiment.

FIGS. 3 and 4 illustrates an optical lens assembly including two optical lenses 3 according to a first embodiment of the disclosure for projecting forwardly light rays generated by two light sources 2. The two optical lenses 3 are juxtaposed in a left-right direction and connected integrally to each other so as to respectively cooperate with the light source 2. Because the optical lenses 3 are structurally identical to each other, only one of the optical lenses 3 and a respective one of the light sources 2 are fully described hereinafter.

Figure 5:
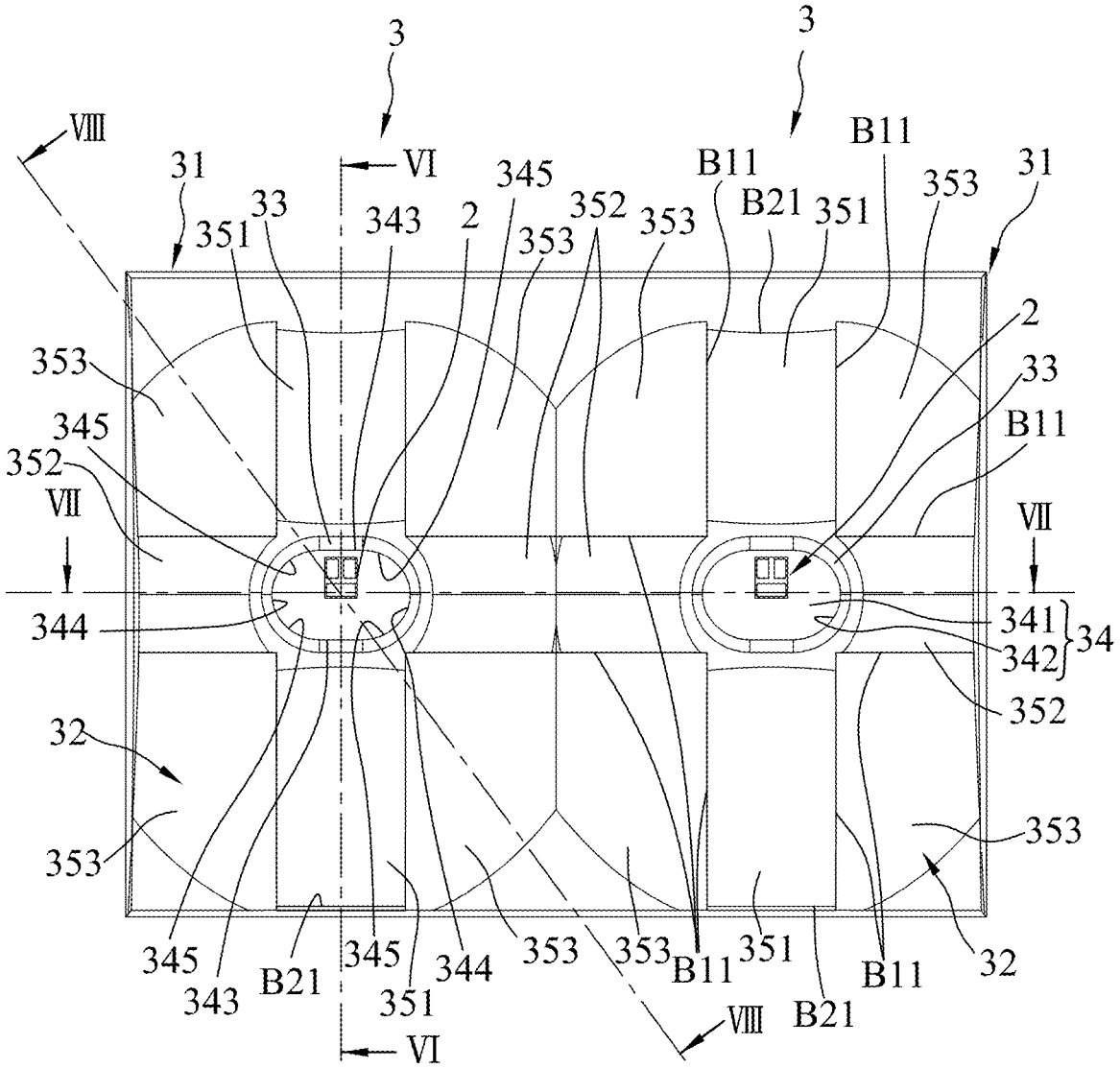
FIG. 5 is a rear view of the first embodiment.
Figure 6:
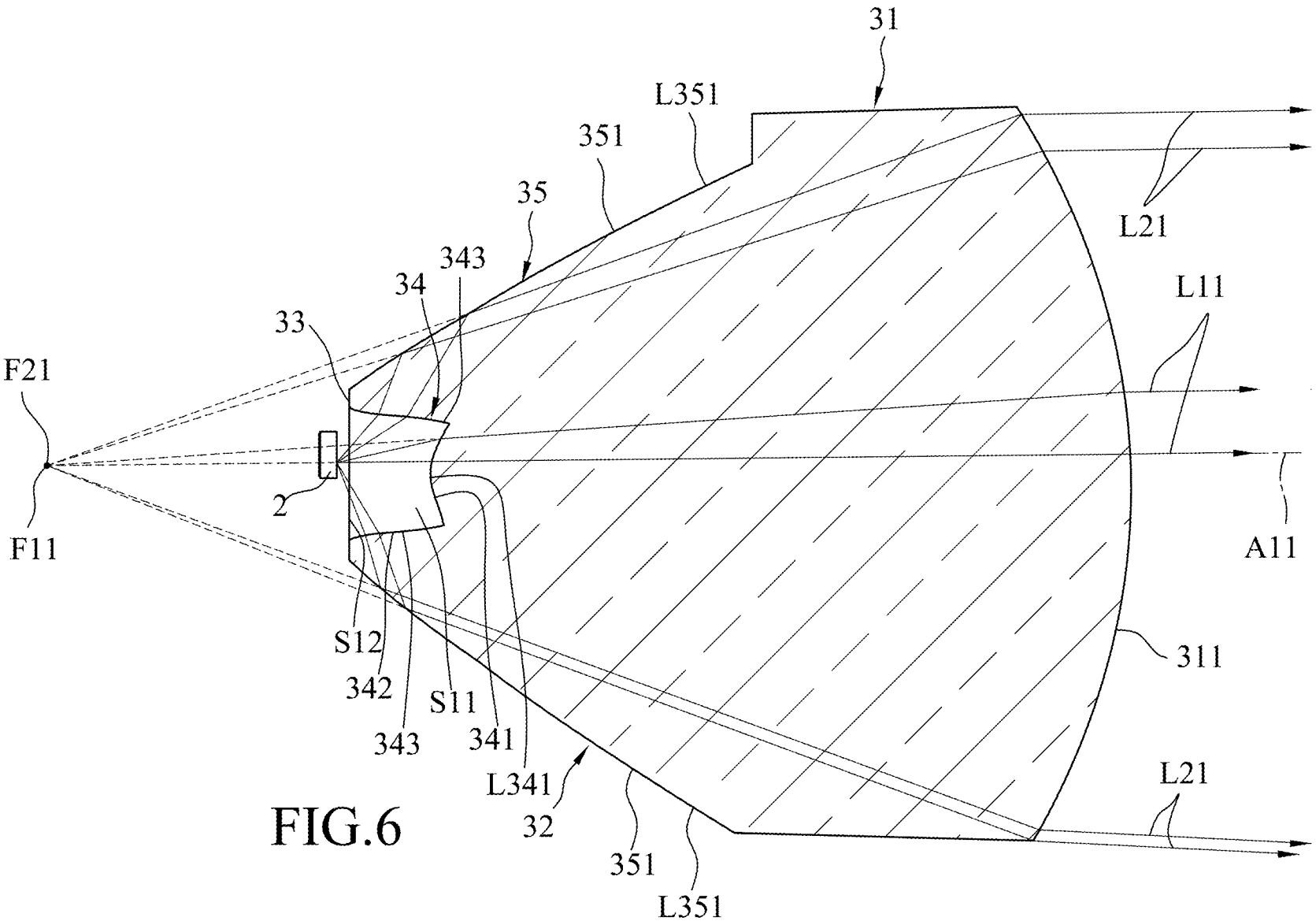
FIG. 6 is a sectional view taken along line VI-VI of FIG. 5.

Referring to FIGS. 5 and 6 in combination with FIG. 4, the optical lens 3 defines an optical axis (A11), and includes a front lens part 31 and a rear lens part 32 that is disposed rearwardly of the front lens part 31 and that is integrally connected to the front lens part 31.

The front lens part 31 has a light exit surface 311 adapted to forwardly projecting light rays from the light source 2. The light exit surface 311 is in the form of a portion of a cylindrical surface and is convexed from rear to front along the optical axis (A11). The light exit surface 311 defines a main focal point (F11) that is situated on the optical axis (A11) and that is disposed rearwardly of the rear lens part 32 (see FIG. 6).

The rear lens part 32 has a rear end 33, a light entry portion 34, and a reflective portion 35.

The rear end 33 is the rearmost of the optical lens 3. As shown in FIG. 6, in this embodiment, the rear lens part 32 further has a light entry space (S11) extending forwardly from the rear end 33, and an opening (S12) that opens at the rear end 33 and that spatially communicates with the light entry space (S11).

The light entry portion 34 is concaved forwardly from the rear end 33 and is adapted to receive incidence of the light rays. As shown in FIG. 6, the light entry portion 34 surrounds the light entry space (S11).

In this embodiment, the light entry portion 34 has a main light entry surface 341 and a light entry surrounding surface 342. The main light entry surface 341 is disposed forwardly of the opening (S12) in a spaced-apart manner and in front of the light entry space (S11). The light entry surrounding surface 342 is connected around and extends forwardly from the opening (S12), and is connected to the main light entry surface 341. The main light entry surface 341 and the light entry surrounding surface 342 cooperatively define the light entry space (S11).

Figure 7:
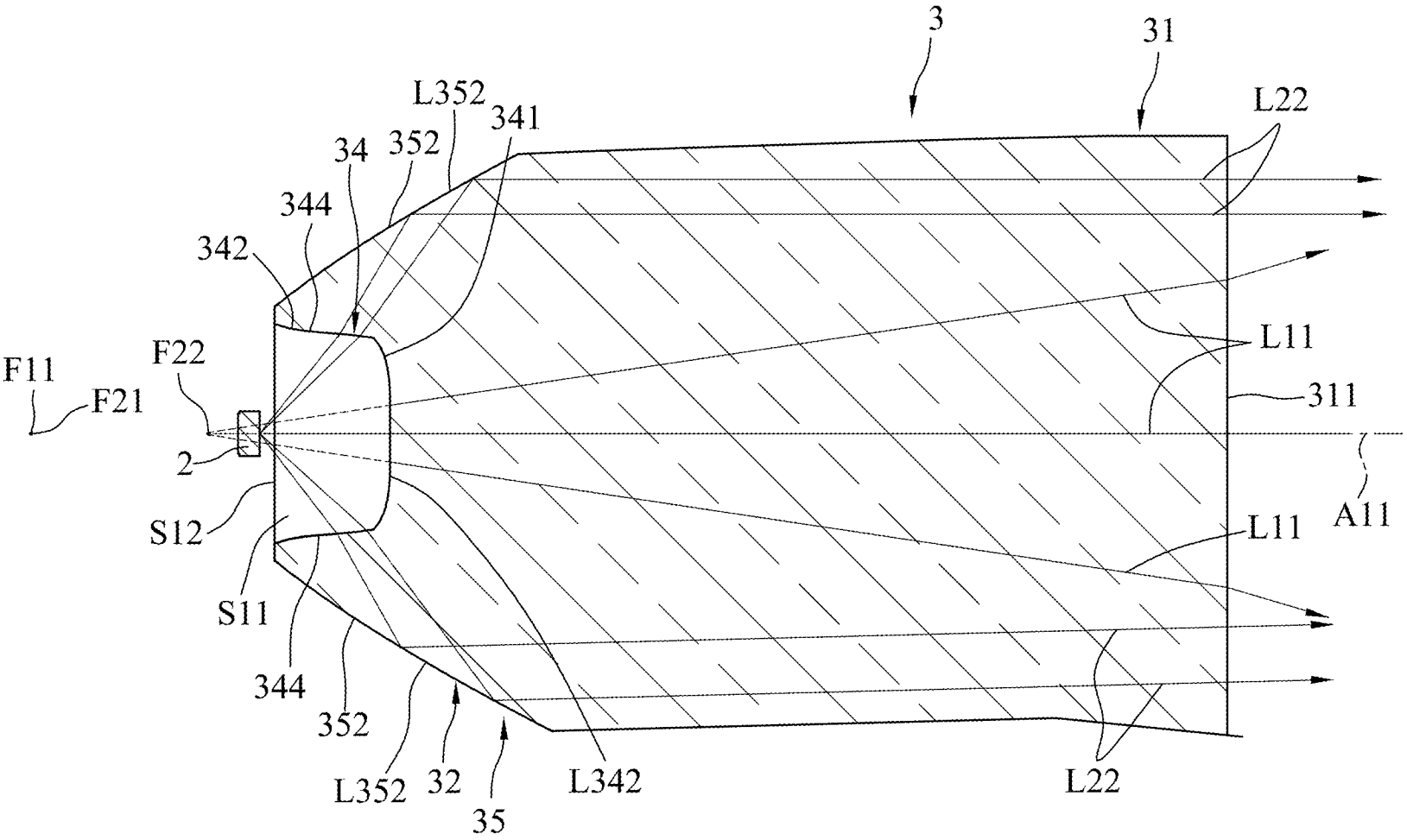
FIG. 7 is a sectional view taken along VII-VII of FIG. 5, illustrating an optical lens of the first embodiment.
Figure 8:
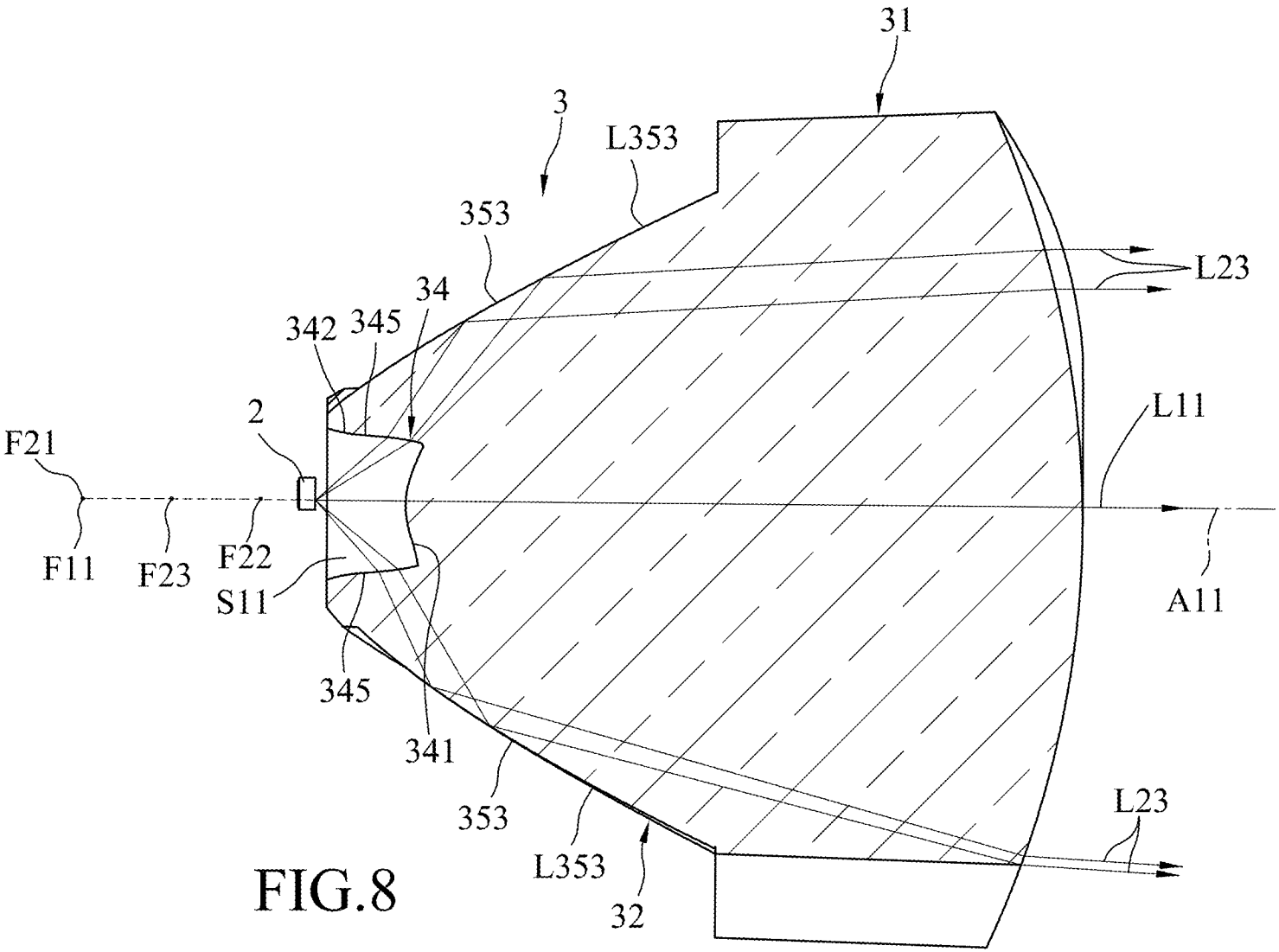
FIG. 8 is a sectional view taken along line VIII-VIII of FIG. 5.

Referring to FIGS. 6, 7 and 8 in combination with FIG. 5, the optical lens 3 is sectioned in a top-bottom direction of the light entry portion 34 along line VI-VI, in a left-right direction of the light entry portion 34 along line VII-VII and in an inclining direction along line VIII-VIII that obliquely intersects lines VI-VI and VII-VII.

Referring back to FIG. 6, the main light entry surface 341 has a cross section that is formed along line VI-VI has a cross sectional curve (L341) convexed rearwardly toward the opening (S12). As shown in FIG. 6, the main light entry curve (L341) defines a virtual focal point (F21) coinciding with the main focal point (F11). The main light entry surface 341 has a shape formed by the cross sectional curve (L341) moving in the left-right direction. That is to say, the cross section of the main light entry surface 341 is uniform in shape and size from the left end to the right end of the main light entry surface 341. As shown in FIG. 7, the main light entry surface 341, when sectioned along line VII-VII, has a cross sectional curve (L342) with a less degree of bending compared to the cross sectional curve (L341). As shown in FIG. 8, the main light entry surface 341, when sectioned along line VIII-VIII, has a cross section with a degree of bending intermediate between the degrees of bending of the cross sectional curves (L341, L342).

Referring back to FIGS. 4 to 6, the light entry surrounding surface 342 tapers slightly and forwardly from the rear end 33, and has two first light incident surface segments 343, two second light incident surface segments 344, and two pairs of third light incident surface segments 345. As shown in FIG. 5, the first light incident surface segments 343 are spaced apart from each other in the top-bottom direction. The second light incident surface segments 344 are concaved away from each other in the left-right direction. Each third light incident surface segment 345 is disposed between one of the first light incident surface segments 343 and one of the second light incident surface segments 344. Each of the second surface segments 344 and an adjacent one of the third surface segments 345 are continuously and curvedly connected to each other. The third light incident surface segments 345 of each pair are diagonally opposite to each other.

The reflective portion 35 extends forwardly from the rear end 33 and surrounds the light entry portion 34 in a manner that the reflective portion 35 is disposed outwardly around the first, second and third light incident surface segments 343, 344, 345 of the light entry portion 34. The reflective portion 35 has two first reflective surfaces 351, two second reflective surfaces 352, and a plurality of third reflective surfaces 353. As shown in FIGS. 5 and 6, the first reflective surfaces 351 are respectively disposed on top and bottom sides of the light entry portion 34 (i.e., above and below the first light incident surface segments 343). As shown in FIGS. 5 and 7, the second reflective surfaces 352 are respectively disposed at left and right sides of the light entry portion 34 (i.e., at outer sides of the second light incident surface segments 344). As shown in FIGS. 5 and 8, each third reflective surface 353 is disposed between one of the first reflective surfaces 351 and one of the second reflective surfaces 352 and at outer sides of the third light incident surface segments 345. The first, second, and third reflective surfaces 351, 352, 353 together form a discontinuous stepped surface around the light entry portion 34. Each of the first, second, and third reflective surfaces 351, 352, 353 has two border lines (B11) that extends forwardly from the rear end 33 to the front lens part 31. The discontinuous stepped surface is stepped along the border lines (B11) of the first, second and third reflective surfaces 351, 352, 353.

The first reflective surfaces 351 respectively have first cross sections when sectioned by a first section plane extending in the top-bottom direction; each of the first cross sections forming a first parabolic line (L351) with a focal point coinciding with the main focal point (F11). Each first reflective surface 351 has a surface formed by the corresponding first parabolic line (L351) moving in the left-right direction. Therefore, each first reflective surface 351 has a front junction end (B21) that connects the front lens part 31 and that forms a line extending in the left-right direction.

As shown in FIGS. 5 and 7, the second reflective surfaces 352 respectively have second cross sections when sectioned by a second section plane that extends in the left-right direction; each of the second cross sections forms a second parabolic line (L352) with a focal point coinciding with the main focal point (F11). Each second reflective surface 352 has a curvature with a degree of bending greater than that of each first reflective surface 351 and a higher degree of conformity to a true parabolic surface compared to the first reflective surface 351. A greater degree of bending will mean a smaller radius of curvature.

As shown in FIGS. 5 and 8, the third reflective surfaces 353 respectively have third cross sections when sectioned by a third section plane that extends in the inclining direction along line VIII-VIII; each of the third cross sections forms a third parabolic line (L353) with a focal point coinciding with the main focal point (F11). Each third reflective surface 353 has a curvature with a degree of bending greater than that of each second reflective surface 352 and has a higher conformity to a true parabolic surface than that of the second reflective surfaces 352.

Figure 9:
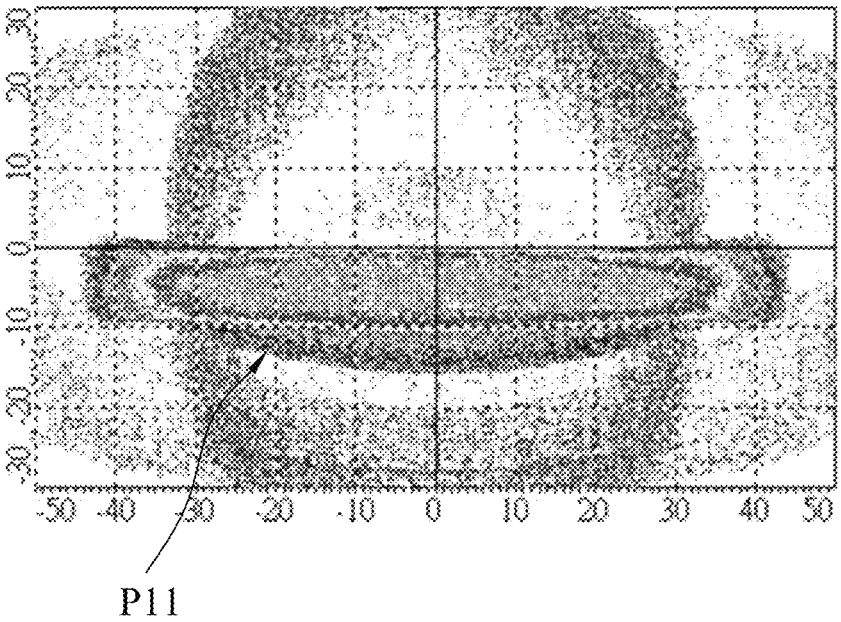
FIG. 9 is a simulation diagram of a main light distribution pattern produced by light incident on a main light entry surface of the first embodiment.

Referring back to FIGS. 6 and 8, when the light rays generated from the light source 2 enter the light entry portion 34, some of the light rays are refracted by the main entry surface 341 and exit from the light exit surface 311 so as to form main light rays (11). As shown in FIG. 9, a main light distribution pattern (P11) is formed by the main light rays (11).

As shown in FIG. 6, when the main light rays (11) is refracted by the main entry surface 341, because the main light entry surface 341 has the cross sectional curve (L341), extension lines of some refracted main light rays (11) will intersect at the virtual focal point (F21) coinciding with the main focal point (F11).

As shown in FIG. 7, when the main light rays (11) is refracted by the main entry surface 341, as the main entry surface 341 has the cross sectional curve (L342), extension lines of some refracted light rays (11) will intersect at a virtual focal point (F22) that is anterior to the virtual focal point (F21)/the main focal point (F11) and posterior to the light source (2). In FIG. 7, the position of the virtual focal point (F21) as shown is just for explaining relative positions of the focal point (F21), the main focal point (F11) and the light source; the virtual focal point (F21) is not actually formed on the sectioning plane along line VII-VII of FIG. 5.

As shown in FIG. 8, because the degree of bending of the cross section of the main light entry surface 341 along line VIII-VIII is intermediate between the degrees of bending of the cross sections of the main light entry surface 341 along lines VI-VI and VII-VII, when the main light rays (11) is refracted by the main light entry surface 341, extension lines of some refracted main light rays (11) will intersect at a virtual focal point (F23) that is anterior to the virtual focal point (F21) and posterior to the virtual focal point (F22). In FIG. 8, the positions of the virtual focal points (F21, F22) as shown are just for explaining relative positions of the focal points (F21, F22), the main focal point (F11) and the light source; the virtual focal points (F21, 22) are not actually formed on the sectioning plane along line VIII-VIII of FIG. 5.

Noteworthy, the virtual focal point (F23) of the main light entry surface 341 is changeable in position when the position of the third sectioning plane along line VIII-VIII is changed. Specifically, when the third sectioning plane is proximate to a perpendicular plane parallel with the top-bottom direction of the light entry portion 34, the virtual focal point (F23) becomes proximate to the virtual focal point (F21). When the third sectioning plane is proximate to a horizontal plane parallel with the left-right direction of the light entry portion 34, the virtual focal point (F23) becomes proximate to the t virtual focal point (F22). The position of the virtual focal point (F23) is variable, and the virtual focal point (F23) shown in FIG. 8 is merely an exemplification.

As shown in FIGS. 6 to 8, because the main light entry surface 341 has different curvatures with different degrees of bending, the main light entry surface 341 has different virtual focal points (F21, F22, F23). Therefore, the main light rays (L11) as shown in FIGS. 6 to 8 are formed into different light patterns which cooperate with one another to provide the main light distribution pattern (P11) as shown in FIG. 9. In detail, the main light rays (L11) as shown in FIG. 6 are focused light rays to constitute a central light region of the main light distribution pattern (P11) as shown in FIG. 9. The main light rays (L11) as shown in FIG. 7 are spread light rays to constitute spread regions at left and right sides of the main light distribution pattern (P11). The main light rays (L11) as shown in FIG. 8 are linking light rays to form linking regions connecting the central light region and the spread regions of the main light distribution pattern (P11).

Figure 10:
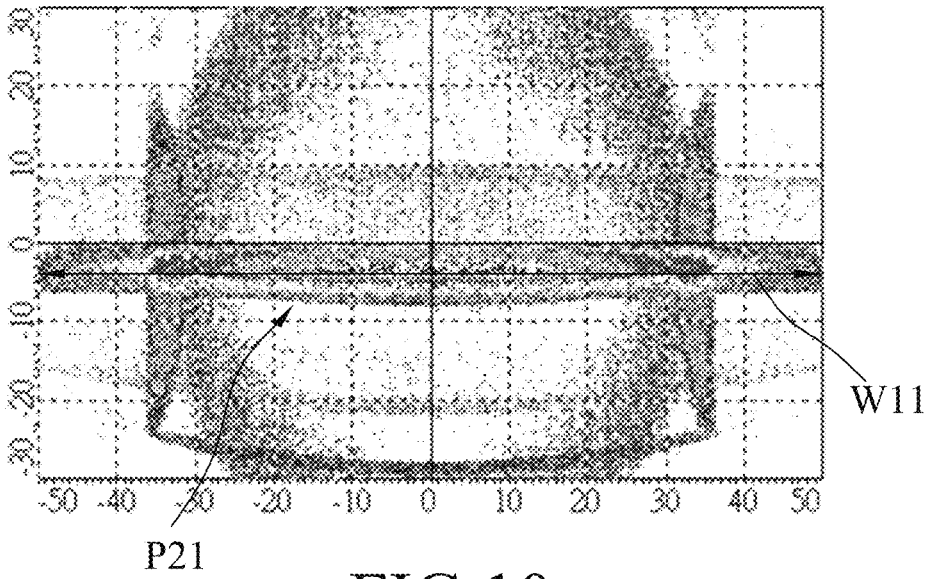
FIG. 10 is a simulation diagram of a projected first light pattern produced by light reflected from two first reflective surfaces of the first embodiment.

Referring to FIG. 10 in combination with FIGS. 4 and 6, after the light rays generated from the light source 2 enter the light entry portion 34, some of the light rays are incident through the first light incident surface segments 343 and in turn are reflected by the first reflective surfaces 351 to exit from the light exit surface 311 to form first light rays (L21) (see FIG. 6). As shown in FIG. 10, a projected first light pattern (P21) is formed by the first light rays (L21).

Because the focal points of the first parabolic lines (L351) of the first reflective surfaces 351 coincide with the main focal point (F11) of the light exit surface 311, the projected first light pattern (P21) formed by the first light rays (L21) is distributed concentratedly in the horizontal direction (i.e., the left-right direction). Specifically, as shown in FIG. 10, the projected first light pattern (P21) formed by the first light rays (L21) is distributed concentratedly and horizontally in a region of 0 to −8 degrees below the horizontal line.

Because each first reflective surface 351 is formed by the corresponding first parabolic line (L351) moving in the left-right direction, the projected first light pattern (P21) is extendable leftward and rightward. Specifically, the projected first light pattern (P21) has a first width (W11) in the left-right direction (horizontal direction) that ranges between ±50 degrees (see FIG. 10).

Figure 12:
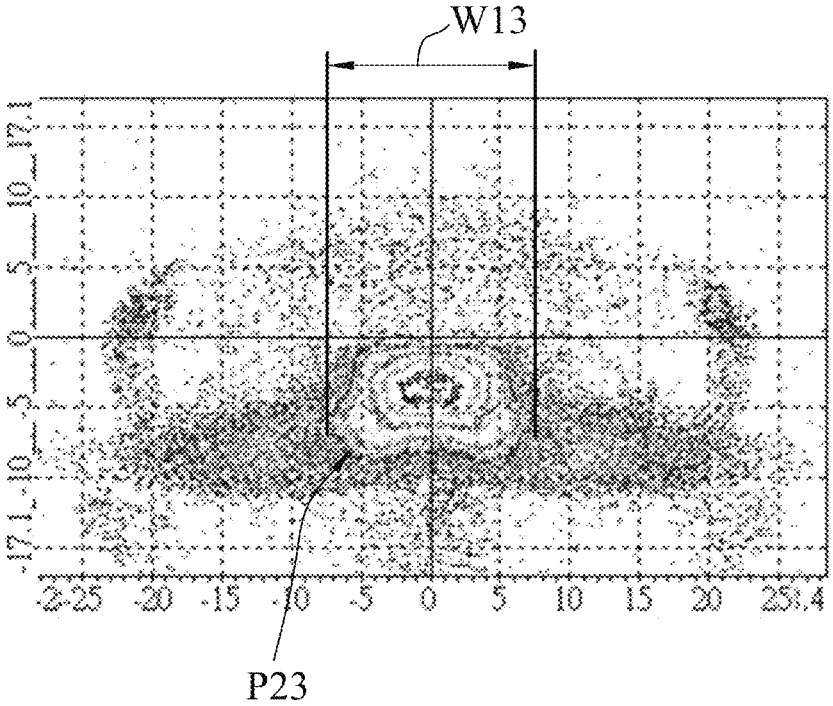
FIG. 12 is a simulation diagram of a projected third light pattern produced by light reflected from third reflective surfaces of the first embodiment.

Referring to FIG. 12 in combination with FIGS. 4 and 8, after the light rays generated from the light source 2 enter the light entry portion 34, some of the light rays are incident through the third light incident surface segments 345 and in turn are reflected by the third reflective surfaces 353 to exit from the light exit surface 311 to form a third light rays (L23) (see FIG. 8), As shown in FIG. 12, a projected third light pattern (P23) is formed by the third light rays (L23).

Because the third reflective surfaces 353 have the largest degree of bending among the first, and second reflective surfaces 351, 352 and thus has the highest conformity to a parabolic surface, the projected third light pattern (P23) is most concentrated at a central region where the horizontal line intersects the vertical line (FIG. 12). Specifically, the main bright region of the projected third light pattern (P23) has a third width (W13) in the horizontal direction, which is in a range of ±7.5 degrees (see FIG. 12).

Figure 11:
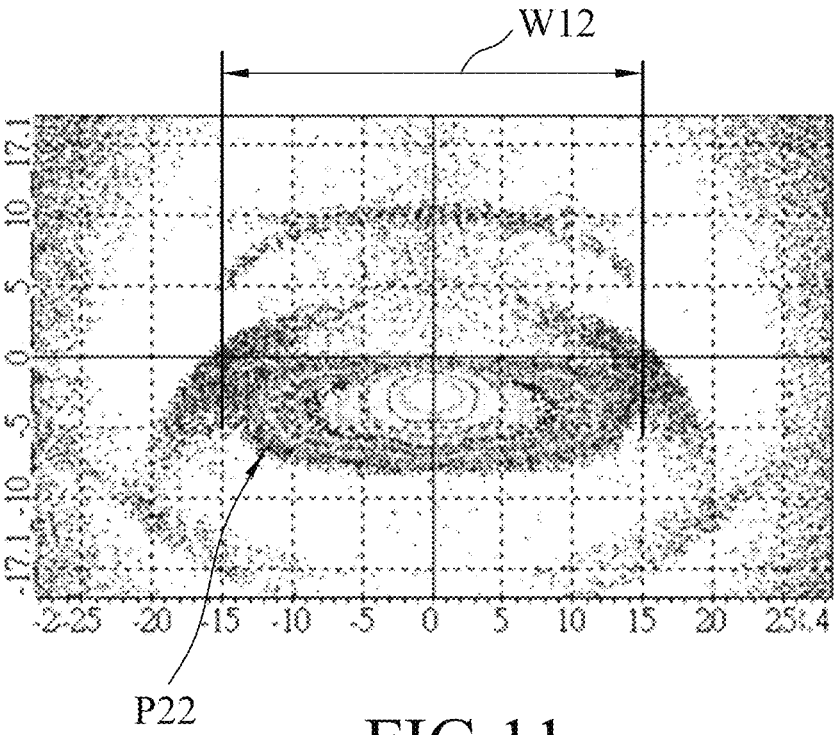
FIG. 11 is a simulation diagram of a projected second light pattern produced by light reflected from two second reflective surfaces of the first embodiment.

Referring to FIG. 11 in combination with FIGS. 4 and 7, after the light rays generated from the light source 2 enter the light entry portion 34, some of the light rays are incident through the second light incident surface segments 344 and in turn are reflected by the second reflective surfaces 352 to exit from the light exit surface 311 to form second light rays (L22) which are parallel (see FIG. 7). As shown in FIG. 11, a projected second light pattern (P22) is formed by the second light rays (L22).

Because the degree of bending of each second reflective surface 352 is intermediate between the degrees of bending of the first and third reflective surfaces 351, 353, the projected second light pattern (P22) has a second width (W12) in the horizontal direction, which is in a range of ±15 degrees. That is, the first width (W11) is greater than the second width (W12) that is greater than the third width (W13).

Figure 13:
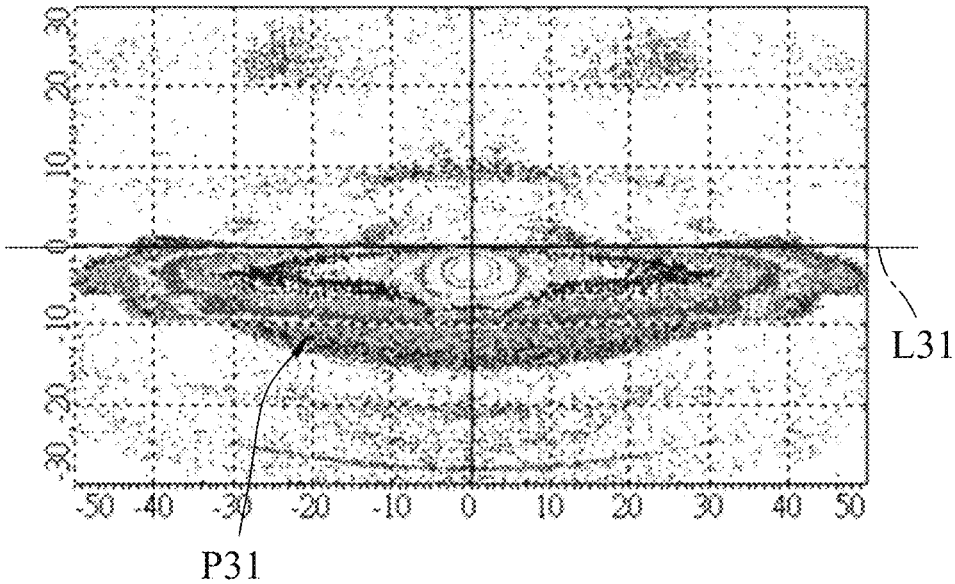
FIG. 13 is a simulation diagram showing the light patterns of FIGS. 9 to 12 which are put together in a stack.

Referring to FIG. 13, a low beam light distribution pattern (P31) is formed by stacking the projected first, second and third light patterns (P21, P22, P23) on one another. Specifically, the low beam light distribution pattern (P31) forms a bright/dark cut-off line (L31) located in the vicinity of 0 degrees in the vertical line.

In this embodiment, the first, second and third reflective surfaces 351, 352, 353 are inner surfaces of the rear lens part 32 and cooperatively surround the light entry surrounding surface 342 in the form of the discontinuous stepped surface. The first, second and third reflective surfaces 351, 352, 353 have differently designed surface profiles to produce different projected light patterns that are formed into the low beam light distribution pattern (P31) when stacked on one another.

The optical lens 3 includes the following advantageous features.

Compared to the prior art, the reflective portion 35 has differently designed zones to produce desired satisfactory light patterns. Specifically, the projected first light pattern (P21) enables the low beam light distribution pattern (P31) to extend horizontally between ±50 degrees. The projected third light pattern (P23) is used to increase brightness at a central region of the low beam light distribution pattern (P31). Because the second width (W12) of the projected second light pattern (P22) is intermediate between the first width (W11) of the projected first light pattern (P21) and the third width (W13) of the projected third light pattern (P23), the projected second light pattern (P22) can smoothly link discrete regions of different brightness formed by the projected first and third light patterns (P21, P23). In addition, by providing more zones of different features (e.g., focal points) in the reflective portion 35, the overall light output efficiency of the optical lens 3 can be increased.

Because the main light entry surface 341 is formed by the cross sectional curve (L341) moving in the left-right direction, it has differently shaped curvatures in different directions (e.g., the directions of planes sectioning the main light entry surface 341 in FIG. 5). Therefore, light rays incident on the main light entry surface 341 may form the focused light region, the spreading light regions, and linking light regions as described hereinbefore so as to produce the main light distribution pattern (P11).

Figure 14:
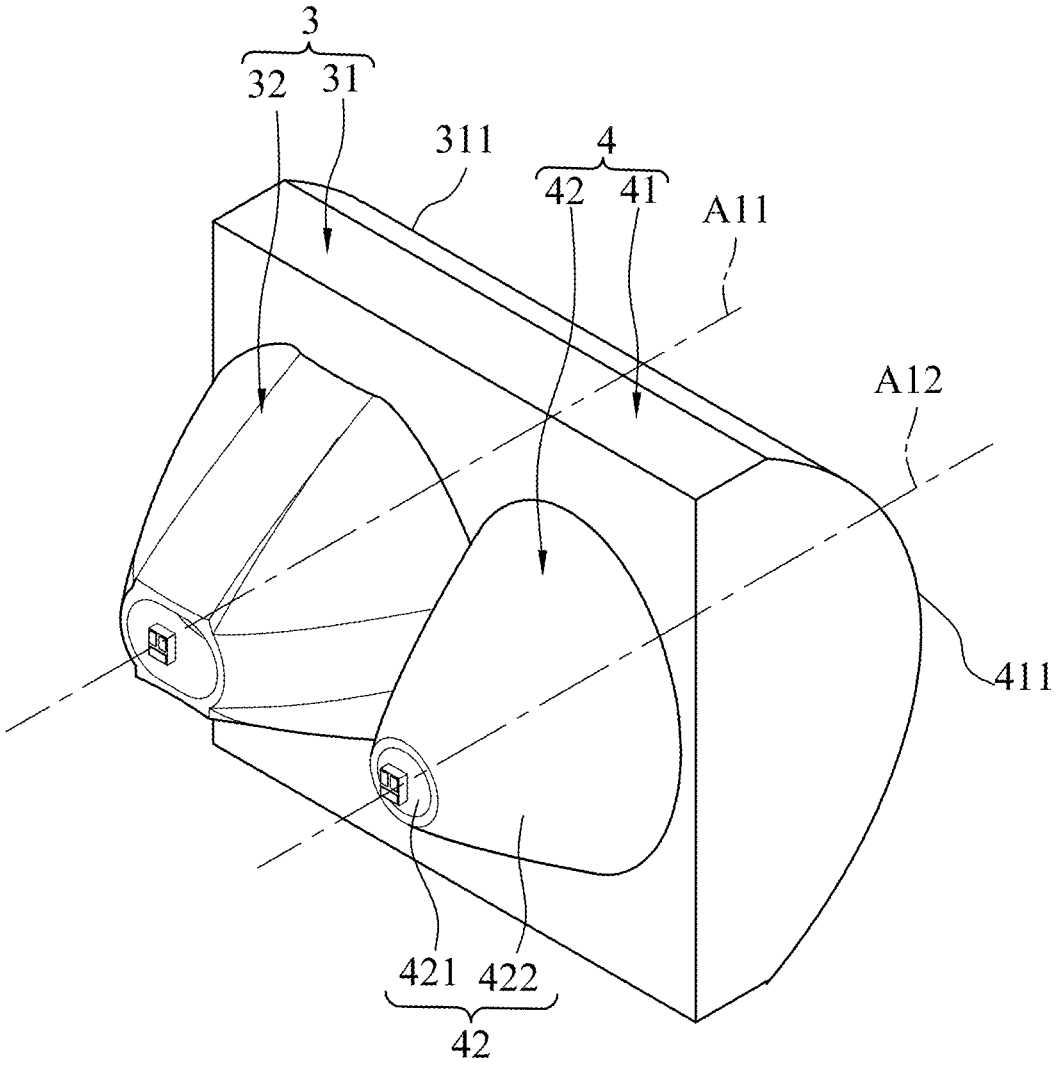
FIG. 14 is a rear perspective view of an optical lens assembly according to a second embodiment of the disclosure.
Figure 15:
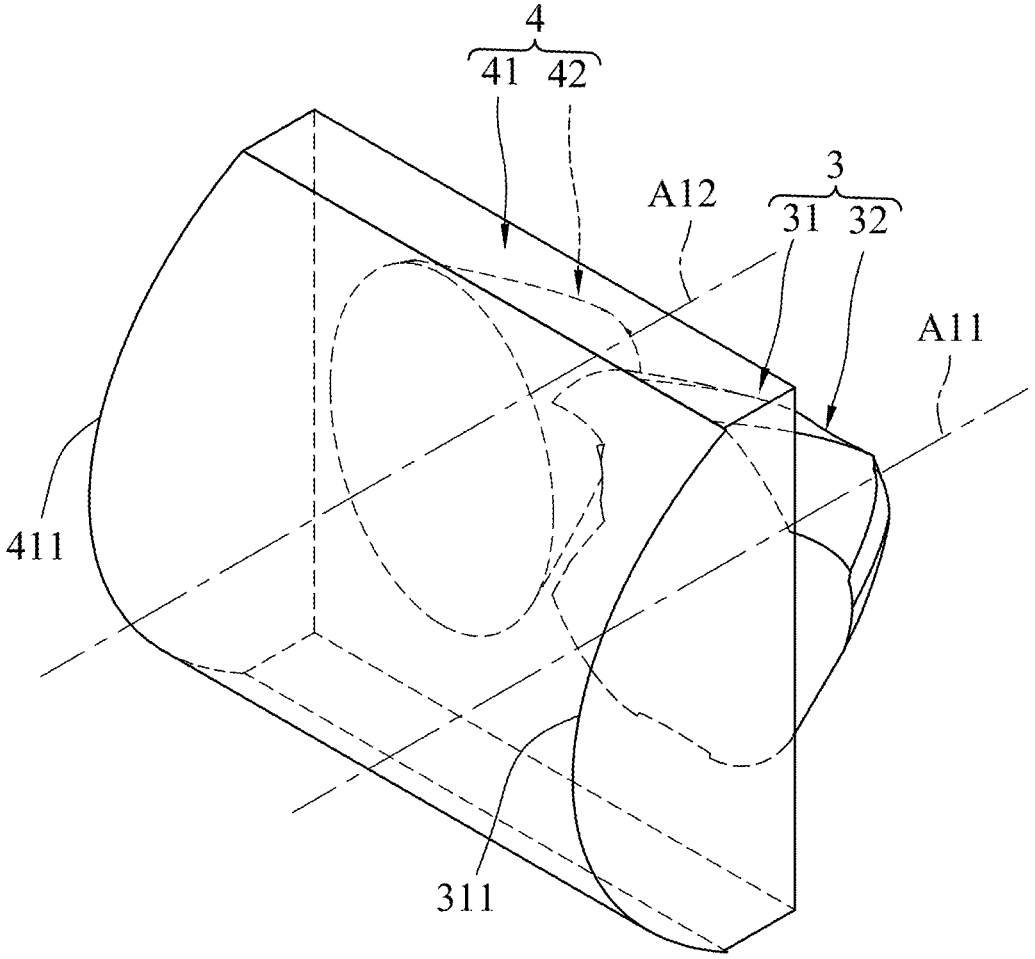
FIG. 15 is a front perspective view of the second embodiment.
Figure 16:
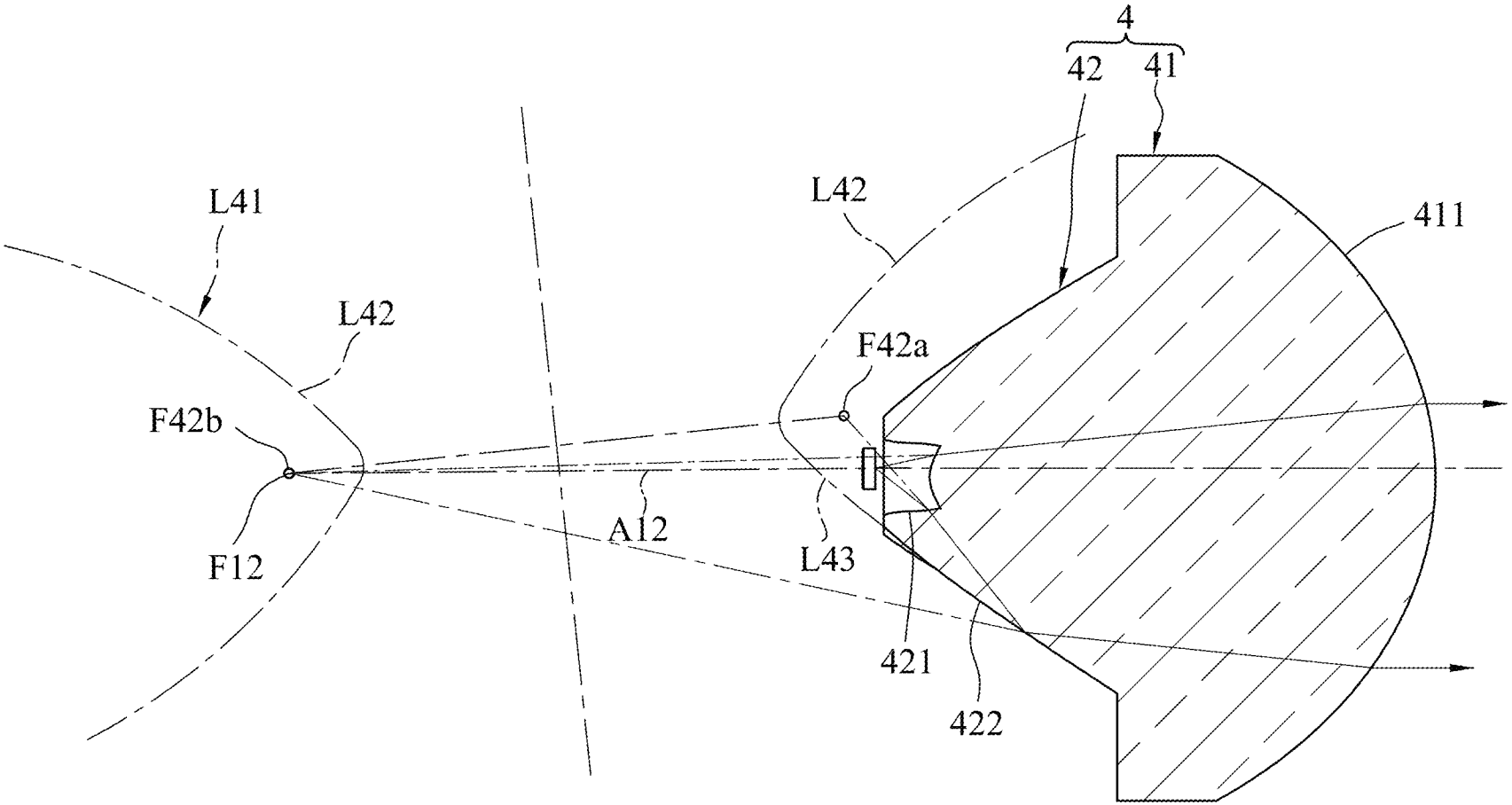
FIG. 16 is a sectional view of the second embodiment, illustrating a high beam lens of the optical lens assembly.

Referring to FIGS. 14 to 16 illustrates an optical lens assembly according to a second embodiment of the disclosure, which has a structure generally similar to that of the first embodiment. However, the difference between the first and second embodiments resides in that a high beam lens 4 replaces one of the optical lenses 3 and is juxtaposed in a left-right direction and connected integrally to the remaining optical lens 3.

Figure 17:
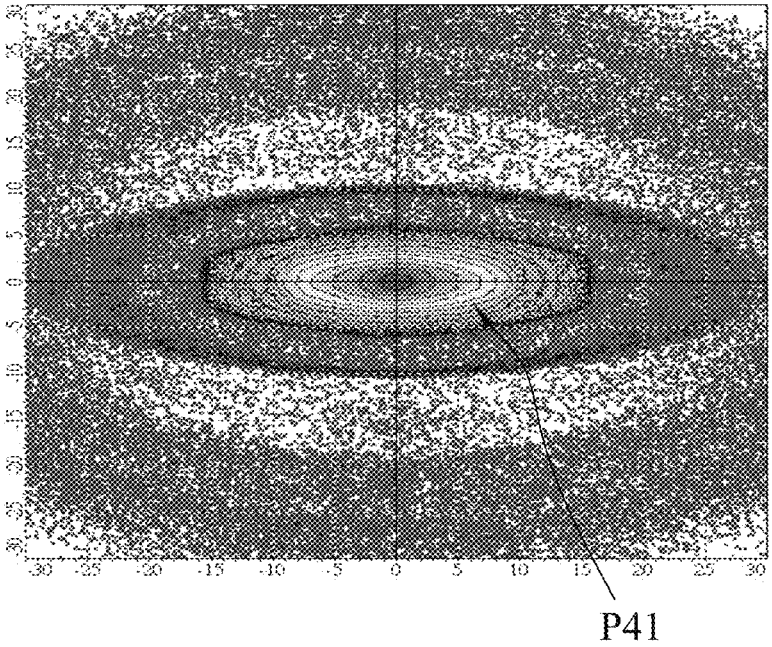
FIG. 17 is a simulation diagram of a high beam pattern produced by the optical lens assembly of the second embodiment.

The high beam lens 4 is adapted to forwardly projecting light rays for producing a high beam pattern (P41) as shown in FIG. 17, and include a first lens part 41 and a second lens part 42 that is connected to and disposed rearwardly of the first lens part 41.

The first lens part 41 having a front end formed with a high beam exit surface 411. The high beam exit surface 411 is in the form of a portion of a cylindrical surface and is coplanar with the light exit surface 311 of the optical lens 3. As shown in FIG. 16, the high beam exit surface 411 defines a focus point (F12) situated on an optical axis (A12) of the high beam lens 4 and disposed rearwardly of the second lens part 42.

The second lens part 42 has a light entry surface 421 that is concaved forwardly from a rear end of the second lens part 42, and a reflecting surface 422 that extends forwardly from the rear end of the second lens part 42 and that surrounds the light entry surface 421 of the second lens part 42.

The reflecting surface 422 is formed by one revolution of an arm segment (L43) of one of two hyperbolic branches (L42) of a hyperbola (L41) about the optical axis (A12) of the high beam lens 4. Therefore, imaginary extension lines of the light rays refracted by the light entry surface 421 of the second lens part 42 intersect at a first imaginary focal point (F42*a*) of the one of the hyperbolic branches (L42). Imaginary extension lines of the light rays reflected by the reflecting surface 422 after being refracted by the light entry surface 421 of the second lens part 42 toward the reflecting surface 422 intersect at a second imaginary focal point (F42*b*) of the other one of the hyperbolic branches (L42). The second imaginary focal point (F42*b*) coincides with the focus point (F12) of the high beam exit surface 411.

More details of the high beam lens 4 producing the high beam pattern (P41) are disclosed in U.S. Pat. No. 10,781,998.

In the second embodiment of the disclosure, because the high beam exit surface 411 of the high beam lens 4 is coplanar with the light exit surface 311 of the optical lens 3, the high beam lens 4 and the optical lens 3 share a common light exit surface so as to provide an integration of a low-beam-light lens and a high-beam-light lens.

Noteworthily, the language "the virtual focal point coinciding with the main focal point" used hereinbefore means that the virtual focal point partially or entirely covers the main focal point.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, the one or more features may be singled out and practiced alone without the another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An optical lens adapted to projecting forwardly a plurality of light rays, comprising:

a front lens part having a light exit surface adapted to forwardly projecting the light rays; and a rear lens part disposed rearwardly of said front lens part, and having a rear end, a light entry portion that is concaved forwardly from said rear end and that is adapted to receive incidence of the light rays, and a reflective portion that extends forwardly from said rear end and that surrounds said light entry portion, said reflective portion having two first reflective surfaces respectively disposed on top and bottom sides of said light entry portion, two second reflective surfaces respectively disposed at left and right sides of said light entry portion, and a plurality of third reflective surfaces each disposed between one of said first reflective surfaces and one of said second reflective surfaces, said first, second, and third reflective surfaces together forming a discontinuous surface around said light entry portion.

2. The optical lens as claimed in claim 1, wherein:

said light exit surface defines a main focal point situated on an optical axis of said optical lens and disposed rearwardly of said rear lens part;

said first reflective surfaces respectively have first cross sections when sectioned by a first section plane extending in a top-bottom direction of said light entry portion, each of said first cross sections forming a first parabolic line with a focal point coinciding with said main focal point;

said second reflective surfaces respectively have second cross sections when sectioned by a second section plane that extends in a left-right direction of said light entry portion, each of said second cross sections forming a second parabolic line with a focal point coinciding with said main focal point; and said third reflective surfaces have third cross sections when sectioned by a third section plane that intersects obliquely said first and second section planes, each of said third cross sections forming a third parabolic line with a focal point coinciding with said main focal point.

3. The optical lens as claimed in claim 2, wherein each of said first reflective surfaces has a shape formed by moving said first parabolic line in the left-right direction, and a front junction end that connects said front lens part and that forms a line extending in the left-right direction.

4. The optical lens as claimed in claim 1, wherein said rear lens part further has a light entry space extending forwardly from said rear end, and an opening that opens at said rear end and that spatially communicates with said light entry space;

said light entry portion of said rear lens part has a main light entry surface disposed forwardly of said opening in a spaced-apart manner, and a light entry surrounding surface that is connected around and extends forwardly from said opening and that is connected to said main light entry surface;

said first, second and third reflective surfaces are inner surfaces of said rear lens part and cooperatively surround said light entry surrounding surface; and said main light entry surface has a cross section that is formed along a sectioning plane extending in the top-bottom direction and that forms a cross sectional curve convexed rearwardly toward said opening, said main light entry surface has a surface formed by said cross sectional curve moving in a left-right direction from left end to right end of said main light entry surface.

5. The optical lens as claimed in claim 4, wherein:

said light exit surface defines a main focal point situated on an optical axis of said optical lens and disposed rearwardly of said rear lens part; and said main light entry curve defines a virtual focal point coinciding with said main focal point.

6. The optical lens as claimed in claim 1, wherein each of said first, second, and third reflective surfaces has two border lines that extends forwardly from said rear end, said discontinuous surface being stepped along said border lines of said first, second and third reflective surfaces.

7. The optical lens as claimed in claim 1, wherein:

each of said third reflective surfaces has a curvature with a degree of bending greater than that of each of said second reflective surfaces; and each of said second reflective surfaces has a curvature with a degree of bending greater than that of each of said first reflective surfaces.

8. The optical lens as claimed in claim 1, wherein:

each of said first reflective surfaces is adapted to reflecting the light rays to said light exit surface, so that the light rays exit from said light exit surface and form a projected first light pattern that has a first width in a left-right direction;

each of said second reflective surfaces is adapted to reflecting the light rays to said light exit surface, so that the light rays exit from said light exit surface and form a projected second light pattern that has a second width in the left-right direction;

each of said third reflective surfaces is adapted to reflecting the light rays to said light exit surface, so that the light rays exit from said light exit surface and form a projected third light pattern that has a third width in the left-right direction; and said first width is greater than said second width that is greater than said third width.

9. An optical lens assembly, comprising:

an optical lens as claimed in claim 1 adapted to producing a low beam pattern, said light exit surface of said optical lens being in the form of a portion of a cylindrical surface; and a high beam lens adapted to forwardly projecting light rays for producing a high beam pattern, and including a first lens part and a second lens part that is connected to and disposed rearwardly of said first lens part, said first lens part having a front end formed with a high beam exit surface, said high beam exit surface being in the form of a portion of a cylindrical surface and being coplanar with said light exit surface of said optical lens, said second lens part having a light entry surface that is concaved forwardly from a rear end of said second lens part, and a reflecting surface that extends forwardly from said rear end of said second lens part and that surrounds said light entry surface of said second lens part.

10. The optical lens assembly as claimed in claim 9, wherein:

said high beam exit surface defines a focus point situated on an optical axis of said high beam lens and disposed rearwardly of said second lens part;

said reflecting surface of said second lens part is formed by one revolution of an arm segment of one of two hyperbolic branches of a hyperbola about said optical axis of said high beam lens;

imaginary extension lines of the light rays refracted by said light entry surface of said second lens part intersect at a first imaginary focal point of said one of the hyperbolic branches; and imaginary extension lines of the light rays reflected by said reflecting surface after being refracted by said light entry surface of said second lens part toward said reflecting surface intersect at a second imaginary focal point of the other one of the hyperbolic branches, said second imaginary focal point coinciding with said focus point of said high beam exit surface.

* * * * *